US006522114B1

(12) United States Patent
Bakker et al.

(10) Patent No.: US 6,522,114 B1
(45) Date of Patent: Feb. 18, 2003

(54) NOISE REDUCTION ARCHITECTURE FOR LOW DROPOUT VOLTAGE REGULATORS

(75) Inventors: Anton Bakker, Delft (NL); Qing He, Gilbert, AZ (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/013,161

(22) Filed: Dec. 10, 2001

(51) Int. Cl.[7] ..... G05F 1/40
(52) U.S. Cl. ..... 323/282
(58) Field of Search ..... 323/273, 280, 323/282, 351

(56) References Cited

U.S. PATENT DOCUMENTS 5,539,603 A 7/1996 Bingham
5,552,697 A 9/1996 Chan
5,563,501 A * 10/1996 Chan ..... 323/282
5,686,821 A 11/1997 Brokaw
5,929,617 A * 7/1999 Brokaw ..... 323/280
6,046,577 A * 4/2000 Rincon-Mora et al. ..... 323/282
6,097,178 A * 8/2000 Owen et al. ..... 323/273
6,144,250 A 11/2000 Owen et al.
6,188,212 B1 2/2001 Larson et al.
6,198,266 B1 3/2001 Mercer
6,333,623 B1 * 12/2001 Heisley et al. ..... 323/280
6,373,233 B2 * 4/2002 Bakker et al. ..... 323/282

* cited by examiner

*Primary Examiner*—Adolf Deneke Berhane
(74) *Attorney, Agent, or Firm*—Peter Zawilski

(57) ABSTRACT

The present invention relates to a low dropout voltage regulator comprising a noise reduction architecture. The low dropout voltage regulator according to the invention comprises a comparison stage for comparing a reference voltage signal with a feedback signal and for providing a first output voltage signal in dependence thereupon. The feedback signal is obtained from a node interposed between a first resistor and a second resistor of a voltage divider. The voltage divider is interposed between an input port for receiving an input voltage signal and ground and is connected to an output terminal of the comparison stage. The first output voltage signal is then low pass filtered prior provision to a gain stage. The gain stage provides gain to the first output voltage signal prior provision to an output port. The noise reduction architecture of the low dropout voltage regulator according to the invention is highly advantageous by providing high efficiency while high frequency noise is substantially reduced.

17 Claims, 3 Drawing Sheets

NOISE REDUCTION ARCHITECTURE FOR LOW DROPOUT VOLTAGE REGULATORS

FIELD OF THE INVENTION

This invention relates to the field of low dropout voltage regulators and, more particularly, to a noise reduction architecture of low dropout voltage regulators for substantially reducing noise.

BACKGROUND OF THE INVENTION

Voltage regulators play a critical role in the proper operation of a large number of modern electronic circuits. It would be virtually impossible to operate the numerous electronic devices such as, for example, PCs or cell phones in the absence of integrated circuit low dropout voltage regulators.

Low dropout voltage regulators produce a regulated output voltage even when the unregulated input voltage from a power source falls to a level very close to that of the regulated output voltage. Because battery voltages typically decrease as batteries are discharged battery operated electronic devices commonly employ low dropout voltage regulators, but their use is by no means limited thereto.

A conventional voltage regulator comprises an input port and an output port, a pass transistor, which is the path element controlled by an error amplifier. A first non-inverting input of the error amplifier is connected to a reference voltage and another inverting input is coupled to a node within a voltage divider coupling the output port to ground. The amplifier compares the reference voltage with a feedback voltage developed at the node and amplifies the difference. Therefore, the gate voltage is controlled by the amplifier based upon the difference between the feedback voltage developed at the node and the reference voltage.

Numerous embodiments of low dropout voltage regulators addressing various application problems are disclosed in the prior art, for example, in U.S. Pat. Nos. 5,539,603, 5,552,697, 5,563,501, 5,686,821, 6,144,250, 6,188,212 and, 6,198,266, which are incorporated hereby for reference.

With increasing clock speed of modern electronic circuits, the modem electronic circuits are becoming more susceptible to high frequency noise inhibiting proper operation of the same. In order to reduce noise some prior art systems employ a low pass filter interposed between the reference voltage and the inverting input of the error amplifier. However, this solution does not address the problem of noise produced by the large resistance of the internal resistor voltage divider.

It is, therefore, an object of the invention to provide a low dropout voltage regulator comprising a noise reduction architecture, which is capable of substantially reducing the noise produced by the internal resistor voltage divider.

It is further an object of the invention to provide a low dropout voltage regulator which is capable of driving a wide range of loads.

SUMMARY OF THE INVENTION

According to the invention there is provided a low dropout voltage regulator comprising:

an input port for receiving an input voltage signal;

an output port for providing a regulated output voltage signal;

a bandgap reference interposed between the input port and ground for providing a reference voltage signal;

a voltage divider comprising a first and a second resistor interposed between the input port and ground;

an error amplifier having a first input terminal coupled to the band gap reference, an output terminal coupled to a first node interposed between the voltage divider and the input port and a second input terminal coupled to a second node interposed between the first and the second resistor of the voltage divider, the error amplifier for comparing a bandgap reference signal received at the first input terminal with a feedback signal received at the second input terminal and for providing a first output voltage signal in dependence thereupon;

a X1 buffer having a first input terminal coupled to the output terminal of the error amplifier, a second input terminal coupled to the output port and an output terminal coupled to a gate terminal of a pass transistor, the pass transistor having a source terminal connected to the input port and a drain terminal connected to the output port, the X1 buffer for providing gain to the first output voltage signal in order to drive a load connected to the output port; and, a low pass filter interposed between the first node and the X1 buffer for filtering the first output voltage signal.

According to the invention there is further provided a low dropout voltage regulator comprising:

an input port for receiving an input voltage signal;

an output port for providing a regulated output voltage signal;

a bandgap reference interposed between the input port and ground for providing a reference voltage signal;

a voltage divider comprising a first and a second resistor interposed between the input port and ground;

a comparison stage having a first input terminal coupled to the band gap reference, an output terminal coupled to a first node interposed between the voltage divider and the input port and a second input terminal coupled to a second node interposed between the first and the second resistor of the voltage divider, the comparison stage for comparing the reference voltage signal received at the first input terminal with a feedback signal received at the second input terminal and for providing a first output voltage signal in dependence thereupon;

a gain stage having an input terminal coupled to the output terminal of the comparison stage for receiving the first output voltage signal and an output terminal coupled to the output port for providing the regulated output voltage signal, the gain stage for providing gain to the first output voltage signal in order to drive a load connected to the output port; and, a filter element interposed between the first node and the gain stage for filtering the first output voltage signal.

According to an aspect of the invention there is provided a method for providing a regulated output voltage signal comprising the steps of:

providing an input voltage signal;

providing a bandgap reference voltage signal;

using a comparison stage, comparing the bandgap reference voltage signal with a feedback signal, the feedback signal being in dependence upon an output voltage signal provided by the comparison stage and the input voltage signal; filtering the output voltage signal; and, using a gain stage, providing gain to the output voltage signal and providing a regulated output voltage signal in dependence thereupon.

The noise reduction architecture of the low dropout voltage regulator according to the invention is highly advantageous by providing high efficiency while high frequency noise is substantially reduced.

BRIEF DESCRIPTION OF THE DRAWINGS

The invention will now be described with reference to the attached drawings in which like reference numerals refer to like objects and in which.

DETAILED DESCRIPTION OF THE INVENTION

Figure 1:
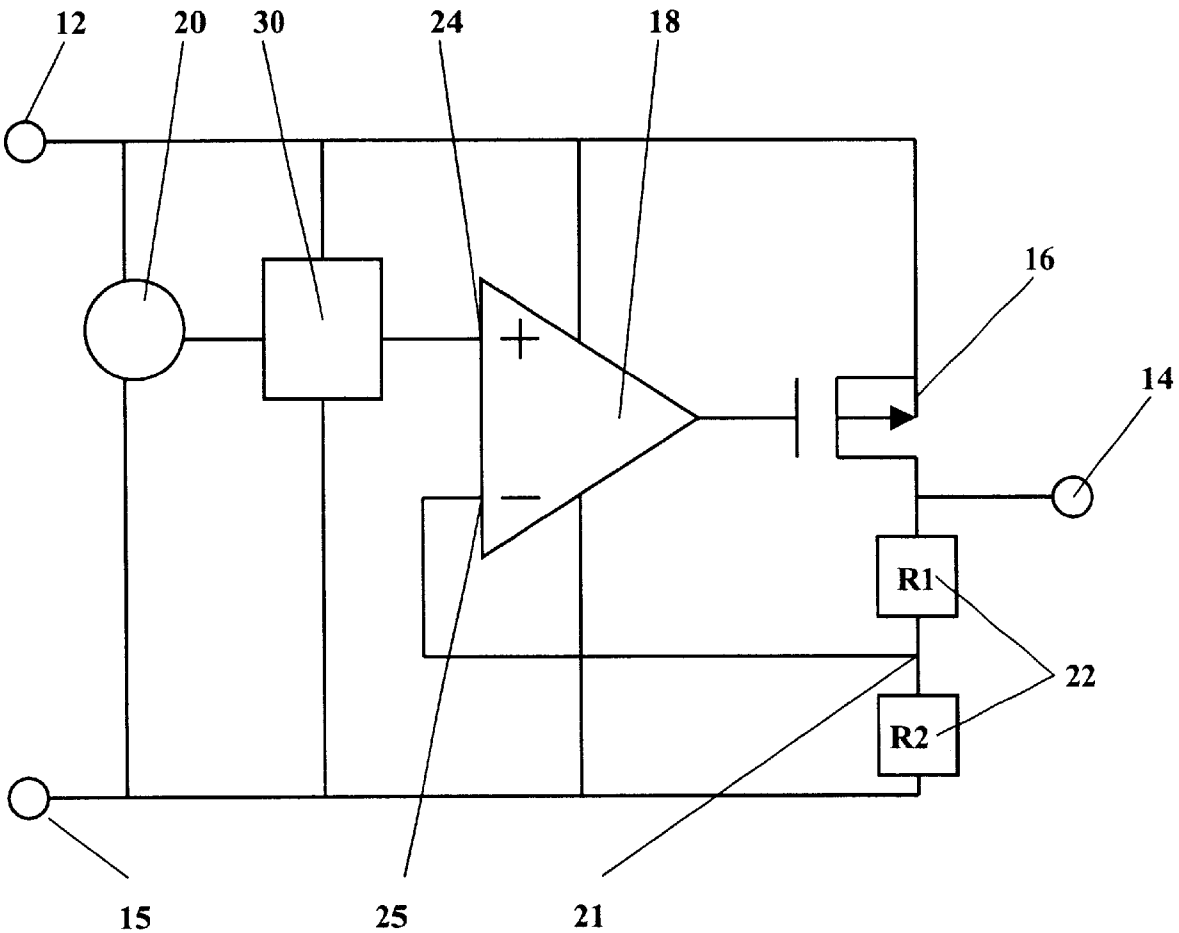
FIG. 1 is a block diagram schematically illustrating a prior art low dropout voltage regulator.

Low dropout voltage regulators are commonly used in power supply systems to provide a regulated voltage at a predetermined multiple of a reference voltage. FIG. 1 shows a simplified block diagram of a typical low dropout voltage regulator (LDO) of the prior art. The regulator comprises an input port 12 and an output port 14, a pass transistor 16, which is the path element controlled by error amplifier 18. A first non-inverting input 24 of the error amplifier 18 is connected to a bandgap reference 20 and another inverting input 25 is coupled to a node 21 within voltage divider 22 coupling the output port 14 to ground 15. The amplifier 18 compares the bandgap reference with a feedback voltage developed at the node 21 and amplifies the difference. Therefore, the output or gate voltage is controlled by the error amplifier 18 based upon the difference between the feedback voltage developed at the node 21 and the bandgap reference 20. In order to reduce noise a low pass filter 30 is interposed between the bandgap reference 20 and the non-inverting input 24 of the error amplifier 18. The LDO provides output voltage regulation independent of the output load current and the input voltage. Ignoring a voltage drop across the pass transistor 16 the LDO provides an output voltage being a predetermined multiple the voltage reference 20.

Adding the low pass filter 30 in front of the error amplifier 18 allows reduction of the noise produced by the bandgap reference 20. However, in order to provide an efficient LDO, i.e. low loss and provision of a regulated output voltage even when the provided input voltage is very close to the output voltage, the internal voltage divider 22 comprises resistors having large resistance and, therefore, contributes a large amount of noise. As a result, it is difficult to provide an efficient LDO having very low noise.

Figure 2:
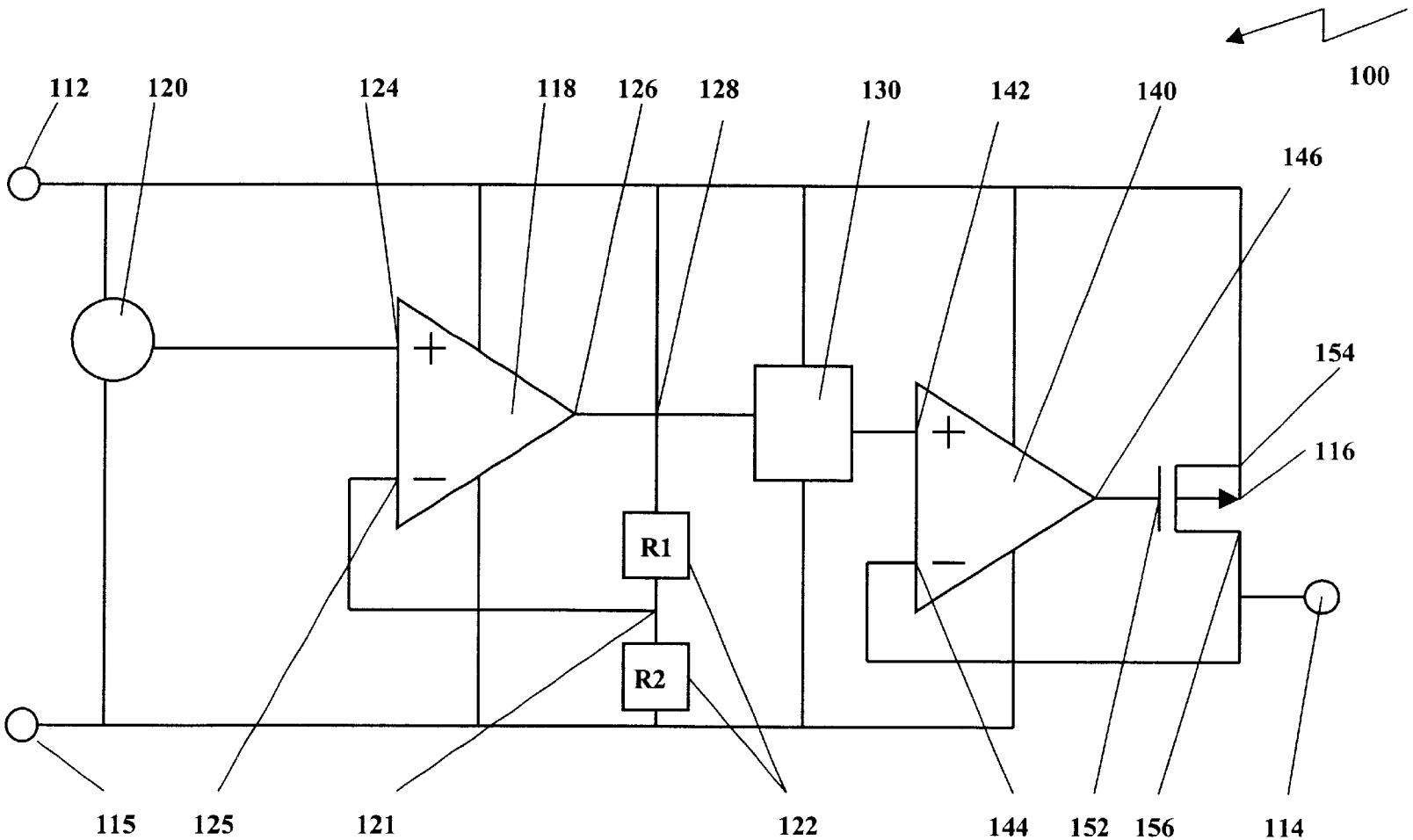
FIG. 2 is a block diagram schematically illustrating a low dropout voltage regulator comprising a noise reduction architecture according to the invention; and, FIG. 3 is a block diagram schematically illustrating another embodiment of a low dropout voltage regulator comprising a noise reduction architecture according to the invention.

The drawbacks of the prior art are overcome by the noise reduction architecture LDO 100 according to the invention shown in FIG. 2. An input voltage signal is provided to the LDO 100 via input port 112. A bandgap reference 120 for providing a reference voltage signal is interposed between the input port 112 and ground 115. A voltage divider 122 comprising a first resistor R1 and a second resistor R2 is interposed between the input port 112 and ground 115. A non-inverting input terminal 124 of error amplifier 118 is coupled to the bandgap reference 120. An output terminal 126 of the error amplifier 118 is coupled to a first node 128 interposed between the voltage divider 122 and the input port 112. An inverting input terminal 125 of the error amplifier 118 is coupled to a second node 121 interposed between the first resistor R1 and the second resistor R2 of the voltage divider. The error amplifier 118 compares the reference voltage signal received at the non-inverting input terminal 124 with a feedback signal received at the inverting input terminal 125 and provides a first output voltage signal in dependence thereupon. A filter element 130 such as a low pass filter is interposed between the first node 128 and the non-inverting input terminal 142 of XI buffer 140. An inverting input terminal 144 of the X1 buffer 140 is coupled to output port 114. Output terminal 146 of the X1 buffer 140 is coupled to gate terminal 152 of pass transistor 116 having a source terminal 154 connected to the input port 112 and a drain terminal 156 connected to the output port 114. The X1 buffer 140 provides gain to the first output voltage signal in order to drive a load connected to the output port 114.

In operation, the error amplifier 118 compares the bandgap reference with a feedback voltage developed at the node 121 and amplifies the difference. Therefore, the gate voltage is controlled by the error amplifier 118 based upon the difference between the feedback voltage developed at the node 121 and the bandgap reference 120. The low pass filter 130 employed after the voltage divider 122 substantially reduces the noise contributed by the large resistance of the voltage divider 122.

There are numerous embodiments for obtaining a low pass filtering function applicable in this architecture. For example, a simple RC circuit combined with a comparator provides sufficient low pass filtering for numerous applications. The comparator is used for start up and then the RC circuit provides the low pass filter function. Other embodiments comprise a higher order linear low pass filter, a switched cap low pass filter or a digital low pass filter.

Interposing a low pass filter between the voltage divider and the output port is highly advantageous by allowing use of high resistance for the voltage divider providing high efficiency of the LDO which is essential for modem battery operated electronic devices while high frequency noise is substantially reduced. Therefore, the noise reduction architecture according to the invention allows the combination of a very efficient LDO with very noise sensitive modern electronic circuits.

The noise reduction architecture 100 according to the invention allows use of a simple differential input amplifier as the error amplifier 118 because its load is fixed through the following low pass filter. The X1 buffer 140 provides gain in the loop comprising the pass transistor 116. This loop gain is needed to improve load, line regulation and accuracy of the output voltage provided to output port 114. The X1 buffer 140 and the pass transistor 116 are designed to be capable for driving a wide range of loads as well as for providing a large slew rate. Provision of a large slew rate substantially improves loop response of the LDO to changes in the input voltage or the load. The slew rate limitation typically occurs when the load current steps from zero to full range, for example, when the device is switched ON. Therefore, the X1 buffer 140 and the pass transistor 116 is designed to have high DC gain and phase margin for providing stable operation while driving the big range of loads as well as for providing a large slew rate. A typical topology employed for the combination of the X1 buffer 140 and the pass transistor 116 is a class "A" buffer such as a emitter-follower driving a PMOS pass transistor and an associated parasitic capacitance but is not limited thereto. A person of skill in the art will find numerous standard op-amps for use as X1 buffer 140.

The X1 buffer 140 shown in FIG. 2 comprises voltage feedback. Optionally, a X1 buffer having current feedback is employed.

Further optionally, the low pass filter 130 is integrated within the X1 buffer 140.

Figure 3:
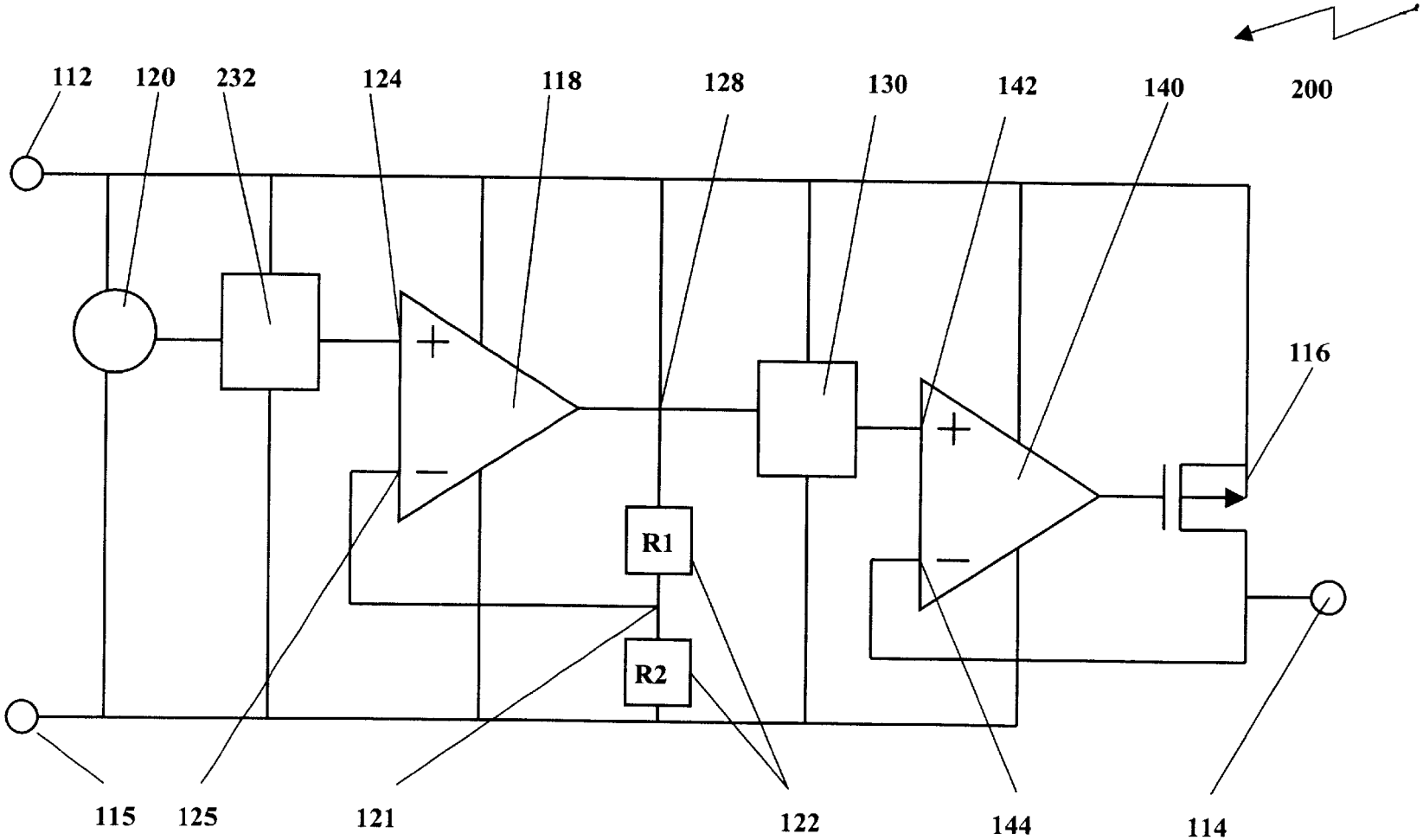

Referring to FIG. 3 another embodiment of a LDO 200 according to the invention is shown. The LDO 200 comprises the same circuit topology as the LDO 100 shown in FIG. 2—like components are indicated by same reference numerals—but has a second low pass filter 232 interposed between the bandgap reference 120 and the non-inverting input 124 of the error amplifier 118. Splitting the filtering function provides advantages for some special applications requiring high-order low pass filtering. In such applications it is worthwhile to add another low pass filter 232 for providing a portion of the filtering before the error amplifier 118.

The low noise architecture according to the invention operates for AC input voltage as well as DC input voltage. Interposing a low pass filter between the voltage divider and the output port allows use of a high resistance for the voltage divider thus providing high efficiency of the LDO while high frequency noise is substantially reduced. Furthermore, the X1 buffer and the pass transistor are designed to have high DC gain and phase margin for providing stable operation while driving a wide range of loads as well as for providing a large slew rate. Therefore, the noise reduction architecture according to the invention is highly advantageous in very noise sensitive modem electronic devices and, particularly, in modern battery operated electronic devices such as, for example, cell phones. Furthermore, it is possible to integrate all components of the LDO according to the invention on a single chip in order to meet space constraints in, for example, small hand-held electronic devices.

Numerous other embodiments may be envisaged without departing from the spirit or scope of the invention.

What is claimed is:

1. A low dropout voltage regulator comprising:

an input port for receiving an input voltage signal;

an output port for providing a regulated output voltage signal;

a bandgap reference interposed between the input port and ground for providing a reference voltage signal;

a voltage divider comprising a first and a second resistor interposed between the input port and ground;

an error amplifier having a first input terminal coupled to the band gap reference, an output terminal coupled to a first node interposed between the voltage divider and the input port and a second input terminal coupled to a second node interposed between the first and the second resistor of the voltage divider, the error amplifier for comparing a bandgap reference signal received at the first input terminal with a feedback signal received at the second input terminal and for providing a first output voltage signal in dependence thereupon;

a X1 buffer having a first input terminal coupled to the output terminal of the error amplifier, a second input terminal coupled to the output port and an output terminal coupled to a gate terminal of a pass transistor, the pass transistor having a source terminal connected to the input port and a drain terminal connected to the output port, the X1 buffer for providing gain to the first output voltage signal in order to drive a load connected to the output port; and, a low pass filter interposed between the first node and the X1 buffer for filtering the first output voltage signal.

2. A low dropout voltage regulator as defined in claim 1, wherein the low pass filter comprises a RC circuit combined with a comparator.

3. A low dropout voltage regulator as defined in claim 1, wherein the X1 buffer comprises a class "A" buffer.

4. A low dropout voltage regulator as defined in claim 3, wherein the pass transistor comprises a PMOS transistor.

5. A low dropout voltage regulator as defined in claim 3, wherein the X1 buffer comprises voltage feedback.

6. A low dropout voltage regulator as defined in claim 1, wherein the low pass filter is integrated within the X1 buffer.

7. A low dropout voltage regulator as defined in claim 1, comprising a second low pass filter interposed between the bandgap reference and the first input terminal of the error amplifier.

8. A low dropout voltage regulator comprising:

an input port for receiving an input voltage signal;

an output port for providing a regulated output voltage signal;

a bandgap reference interposed between the input port and ground for providing a reference voltage signal;

a voltage divider comprising a first and a second resistor interposed between the input port and ground;

a comparison stage having a first input terminal coupled to the band gap reference, an output terminal coupled to a first node interposed between the voltage divider and the input port and a second input terminal coupled to a second node interposed between the first and the second resistor of the voltage divider, the comparison stage for comparing the reference voltage signal received at the first input terminal with a feedback signal received at the second input terminal and for providing a first output voltage signal in dependence thereupon;

a gain stage having an input terminal coupled to the output terminal of the comparison stage for receiving the first output voltage signal and an output terminal coupled to the output port for providing the regulated output voltage signal, the gain stage for providing gain to the first output voltage signal in order to drive a load connected to the output port; and, a filter element interposed between the first node and the gain stage for filtering the first output voltage signal.

9. A low dropout voltage regulator as defined in claim 8, wherein the gain stage is designed to have high DC gain and phase margin.

10. A low dropout voltage regulator as defined in claim 9, wherein the input voltage signal comprises a DC voltage signal.

11. A low dropout voltage regulator as defined in claim 9, wherein the input voltage signal comprises an AC voltage signal.

12. A low dropout voltage regulator as defined in claim 9, wherein all components of the low dropout voltage regulator are integrated on a single chip.

13. A method for providing a regulated output voltage signal comprising the steps of:

providing an input voltage signal;

providing a bandgap reference voltage signal;

using a comparison stage, comparing the bandgap reference voltage signal with a feedback signal, the feedback signal being in dependence upon an output voltage signal provided by the comparison stage and the input voltage signal;

filtering the output voltage signal; and, using a gain stage, providing gain to the output voltage signal and providing a regulated output voltage signal in dependence thereupon.

14. A method for providing a regulated output voltage signal as defined in claim 13, wherein the step of filtering comprises low pass filtering.

15. A method for providing a regulated output voltage signal as defined in claim 14, wherein the step of low pass filtering comprises higher order linear low pass filtering.

16. A method for providing a regulated output voltage signal as defined in claim 15, wherein the step of low pass filtering comprises switched cap low pass filtering.

17. A method for providing a regulated output voltage signal as defined in claim 15, wherein the step of low pass filtering comprises digital low pass filtering.

* * * * *